United States Patent [19]

Szegi

[11] 4,142,627

[45] Mar. 6, 1979

[54] METHOD AND APPARATUS FOR PRESERVING PALETTE PIGMENTS

[76] Inventor: Alexander Szegi, 3915 Calle Cita, Santa Barbara, Calif. 93110

[21] Appl. No.: 866,333

[22] Filed: Jan. 3, 1978

[51] Int. Cl.[2] ..... B44D 7/00; B65D 11/00

[52] U.S. Cl. ..... 206/1.7; 312/31.01; 206/205

[58] Field of Search ..... 21/2; 206/1.7, 1.9, 206/205, 811; 312/31, 31.01, 31.03

[56] References Cited

U.S. PATENT DOCUMENTS

| | | | |
|---|---|---|---|
| 2,728,157 | 12/1955 | Guthrie | 206/205 X |
| 2,914,876 | 12/1959 | Osler | 312/31.01 |
| 2,923,081 | 2/1960 | Simmons | 206/1.7 |
| 3,786,913 | 1/1974 | Crawford | 206/205 X |
| 3,804,030 | 4/1974 | Israel | 206/1.7 X |
| 3,874,499 | 4/1975 | Barnett, Jr. | 206/1.7 |
| 3,885,843 | 5/1975 | Rubel | 206/1.7 X |
| 3,924,733 | 12/1975 | DeLong | 206/1.7 |

*Primary Examiner*—Davis T. Moorhead
*Attorney, Agent, or Firm*—Harry W. Brelsford

[57] ABSTRACT

Pigments are preserved on the surface of an artist's palette by storing the palette in a waterproof container having sufficient water to cover the pigments deposited on the surface of the palette. The container is made flat and small for portability.

5 Claims, 7 Drawing Figures

METHOD AND APPARATUS FOR PRESERVING PALETTE PIGMENTS

This invention relates to containers for artists' palettes to prevent pigments from drying and has particular reference to the use of water in the container to exclude air from the pigments and thereby positively prevent drying of the pigments.

Attempts have been made over the years to provide airtight covers for artists' palettes in an attempt to prevent the paint, colors, or pigment on the palette from drying. Frequently, however, the entrapped air is sufficient to dry these materials past the stage of reusability, and the paints, colors, and pigments must be scraped from the palette and new materials added to the board.

Frequently, the time of the artist is limited and he has only a few free hours in a week to paint. This is especially true of students with other studies and the person who paints as a hobby or relaxation from a vocation. The spare-time artist finds himself spending a major part of his time preparing and getting set up to paint and in cleaning up his brushes, palette, and other equipment and putting them away for the next session. In addition, such brief separated periods of painting tend to be wasteful of expensive materials. Having mixed a number of colors on his palette, the artist usually runs out of time before he runs out of paint. Knowing the paint will be dried out and unusable when he next has an opportunity to paint, he discards it. The next time he wishes to paint he is confronted with the task of mixing a new set of colors or values which must be carefully matched with those he used before. Because colors and values tend to change in tone as they dry, this is a difficult and often frustrating task, and the waste of the expensive materials is often compounded by the necessity of having to repeat an unsuccessful attempt.

I have discovered that oil paints deposited or spread on the surface of a palette can be preserved for days and weeks without drying if the palette is covered with water. I have found that this can be expeditiously done by immersing the palette in a container of water. Since the oil paints are water-repellant, the water quickly runs off them when the palette is removed from the water. The immersion in water does not affect the texture or color of the paints or mixtures of paints and they are immediately ready for use once the palette is removed from the water. When pigments have been exposed to air for long periods, as after repeated use, the artist merely adds a drop of linseed oil to the pigments to restore texture and workability.

SUMMARY OF THE INVENTION

I provide a waterproof and water-repellent palette and a watertight compartment for the palette that allows spacing of the palette from the container walls. When not in use the palette is placed in the container, and I fill the container with water or other fluid that excludes air from the colors, paints, and pigments on the palette. I make my container light in weight and small in bulk to cause it to be readily portable. When the artist desires to use the palette, he opens the watertight container, removes the palette, and allows it to drip dry. The container is then closed to retain the water for the next time the artist ceases painting. The paints, colors, and pigments should be of a type not soluble in water or other fluid filling the container.

DESCRIPTION

Various objects, advantages, and features of the invention will be apparent in the following description and claims considered together with the drawings forming an integral part of this specification and in which:

Figure 1:
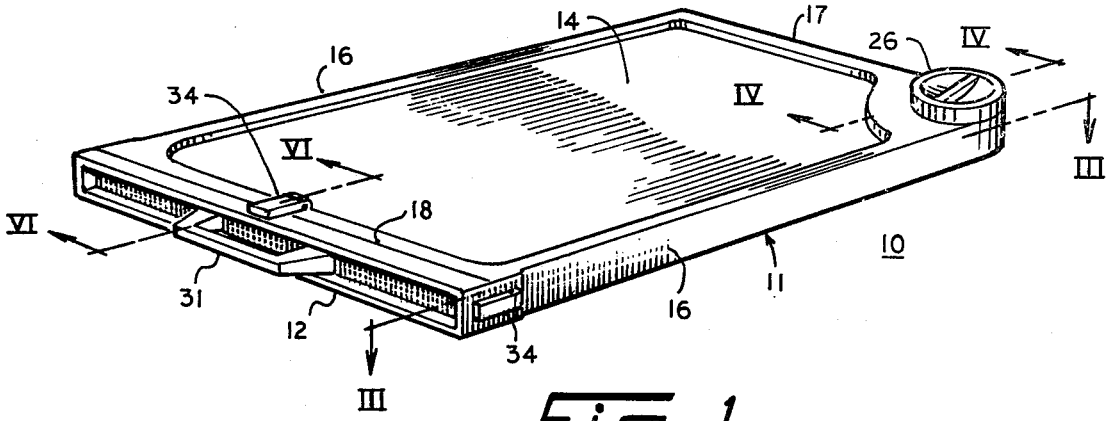
FIG. 1 is a three-dimensional view of the assembly of the waterproof container, the palette disposed inside the container, and the container closed with an end closure.
Figure 2:
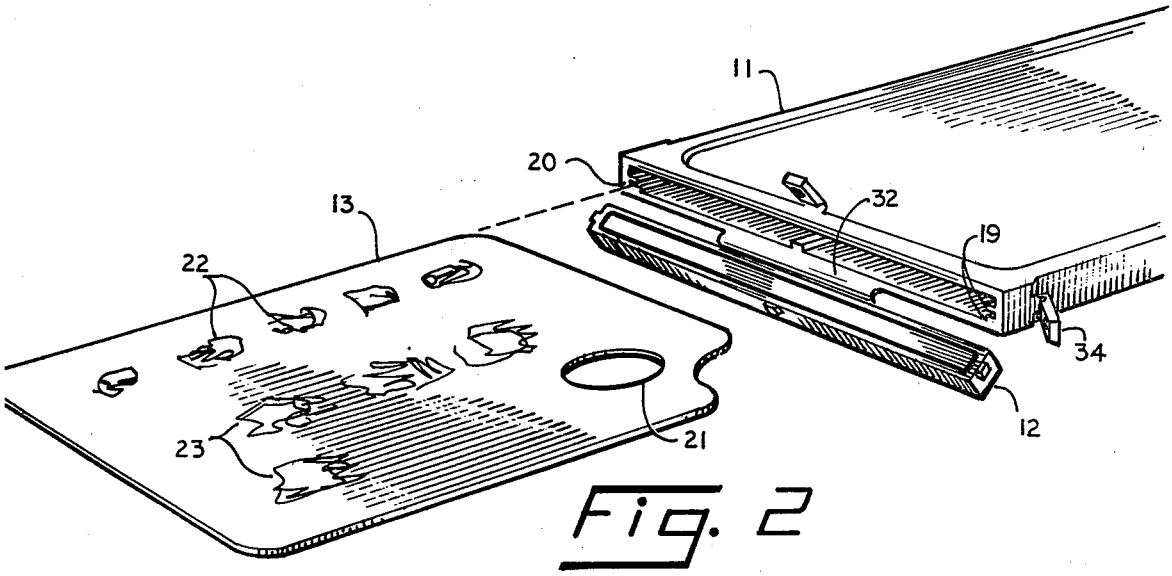
FIG. 2 is an exploded view of part of the container of FIG. 1 showing the closure in an open position and showing the palette removed from the container.
Figure 3:
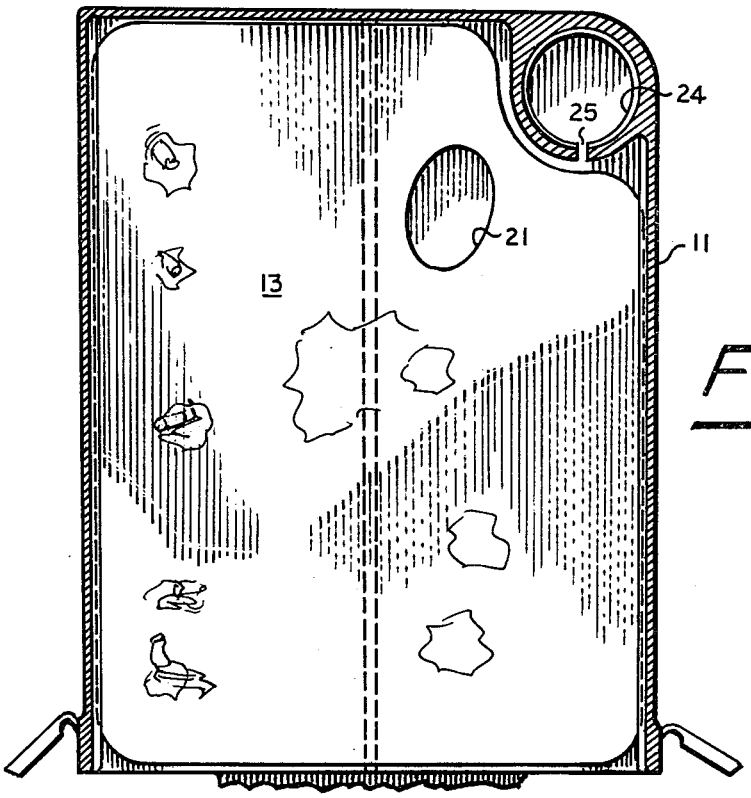
FIG. 3 is a sectional view in plan along the line III—III of FIG. 1.

Referring now to FIGS. 1, 2, and 3, the assembly 10 includes a flat container 11 having an enclosure 12 on one edge thereof and a palette 13 is disposed inside the container for carrying the palette from one location to another. The container 11 has a top wall 14, opposite sides 16, a bottom 17, and an upper edge 18, which is closed by the hinged closure 12. Referring particularly to FIG. 2, it will be noted that the inner surfaces of the opposite edges 16 have guide rails 19 defining a guide slot 20 between them in which is slid the edges of the palette 13.

The palette 13 may be of the conventional arm type of other flat type of palette having the usual thumbhole 21. In use the artist squeezes from his tubes colors or pigments 22 of various colors, and in order to obtain proper shades of color he mixes pigments from the various squeezings or blobs 22 in separate areas 23 until the desired shade is obtained by mixing the various pigments. The pigments 22 are also sometimes referred to as colors and will be referred to in this specification as pigments. The pigments are generally purchased in a squeeze-tube form, and the artist squeezes from the various tubes of color a sufficient quantity of the different pigment colors to accomplish his particular project. The pigments referred to in the preferred form of the invention are oil-based pigments, and these are generally water-repellant and do not dry or set up when covered with water.

Figure 4:
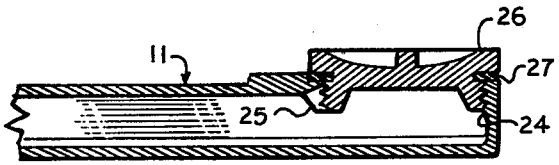
FIG. 4 is a fragmentary sectional view along the line of IV—IV of FIG. 1 showing the construction of the filler cap for the container.
Figure 5:
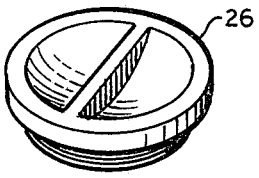
FIG. 5 is a three-dimensional view of the filler cap of FIGS. 1 and 4.

Referring now to FIGS. 4 and 5, it will be noted that in one of the lower corners of the container 16 there is formed a threaded well 24 in which is threaded a removable plug 26 held in watertight relationship thereto by a gasket 27. The well 24 is slotted at 25 to form a breather for air in the container while filling the container 11 when it is horizontal.

Figure 6:
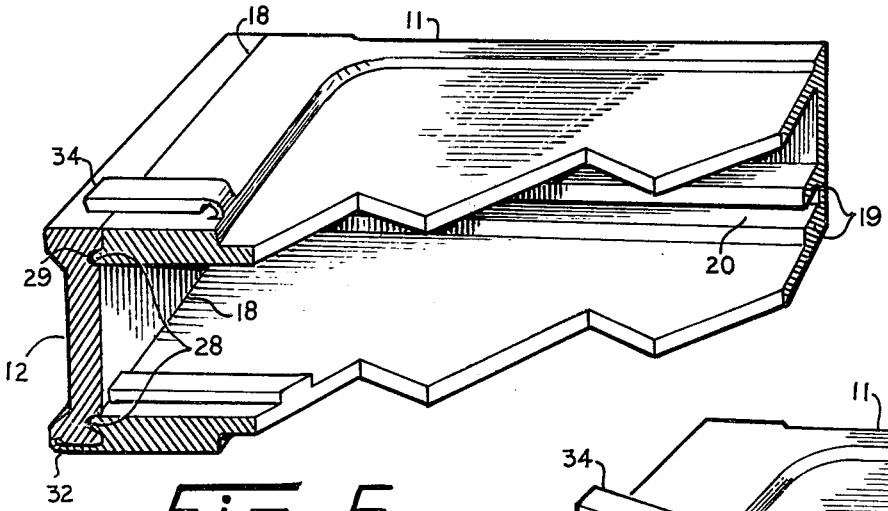
FIG. 6 is a fragmentary breakaway three-dimensional drawing showing the construction of a presently preferred integral plastic hinge for the closure on the container.
Figure 7:
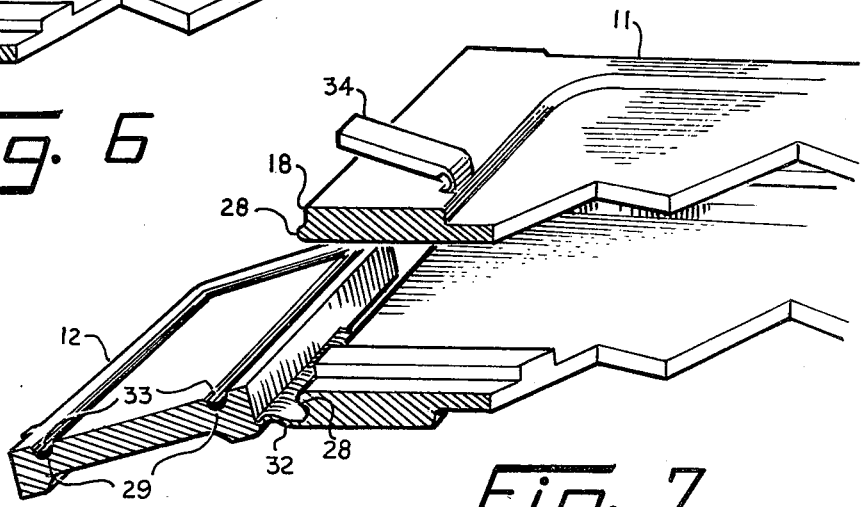
FIG. 7 is a fragmentary three-dimensional view of part of the structure of FIG. 6 showing the closure in an open position as also illustrated in FIG. 2 for removal of the palette.

Referring now to FIGS. 6 and 7, there is illustrated the seal for the enclosure 12. There it will be noted that the two edges 18 of the container have a projecting rib 28, which matches a recess 29 formed in the mating portion of the closure 12. A handle 31 may be secured to the closure 12 by which the entire combination of closure, palette, and container may be carried from one place to another.

Referring now to FIGS. 6, 7, and 2, it will be noted that the closure 12 is hinged to the edges 18 of the container by a flexible hinge 32. This hinge is preferably integrally cast or molded with the container from the same material as the container, and various high-molecular weight plastics have this ability to flex with a hinge-like action to form hinges for lids on various objects as is well known in the plastics industry.

Referring to FIGS. 2 and 7, it will be noted that the grooves 29 of the closure 12 have a gasket 33 formed or deposited in the bottoms of these grooves. The gasket is preferably soft and yielding such as a soft rubber so as to effect a seal when the ribs 28 of the container edge 18 mate with the groove 29.

The closure 12 may be tightly held to the container 11 by suitable buckles or latches 34 and I presently prefer to mold these also integrally with the container using the same type of integral hinge as described with reference to element 32 in FIGS. 6 and 7. Any other suitable latch mechanism may be employed to effect the watertightness of the closure 12 with the container 11.

In use the artist mixes the various pigments 22 in areas 23 in order to obtain the correct shade of color desired inasmuch as the pigments 22 are of different color. These mixings 23 together with the pigments 22 are then applied by the artist to his drawing. When the artist has to cease his painting, he merely slides the palette 13 into the container 11 by guiding it in the slots 20 formed by the rails 19. When the palette is fully positioned inside the container 11, the closure 12 is swung on its hinge 32 to close, and the latches 34 are then secured to maintain the watertightness of the closure 12. The plug 26 is then unscrewed and the container inserted under a faucet until the container is relatively full of water. The plug 26 is then screwed into position against the gasket 27 to make a watertight fit. The artist then grasps the combination of container-palette-water-closure by the handle 31 and carries it with him to its desired location between times of painting.

When next the artist desires to use his palette, he merely stands the container 11 upright, opens the latches 34, swings open the closure 12, and grasps the palette 13 between his fingers, removing it from the container 11. If the artist desires to save the water in the container 11, he then closes the closure 12 and latches it by latches 34 and places it in any convenient place at any desired orientation, whether horizontal or upright. When again he must stop his painting, the container is opened, the palette is slid in place, and the closure closed.

It will be appreciated that the water may be introduced into the container at the closure edge 18, and water may be poured out the same closure edge. However, the screw-in plug 26 of FIG. 5 is convenient for filling from a faucet inasmuch as most faucets are not sufficiently spaced from the bottom of a sink to allow the container to be disposed of vertically under the faucet.

I prefer the palette 13 to be made of material that does not absorb water. Furthermore, I desire that it be somewhat water-repellant so that it can quickly drip dry when it is lifted out of the container 11. I have found that palettes made of white acrylic material of the type sold under the trademark "Plexiglas" are especially suitable. When the artist lifts the acrylic plastic palette out of the container, the water quickly runs off all the pigments 22 and the mixture of pigments 23 and runs quickly off the palette 13 so that the entire palette is almost instantly available for use. The water in the container 11 excludes air from the pigments 22, and, even though stored for several weeks in the container, they do not dry out and are as fresh and soft as they were when the palette was placed in the container 11. This structure and mode of use of the structure completely eliminate the necessity to clean up a palette after it is in use and avoids the necessity for remixing pigments to form desired shades of color. The artist is assured that at the next session of painting he can have the same exact mixture of pigments that he had used previously inasmuch as he works from the same patch or area 23 of these pigment mixtures. Not only does the artist save the entire time of cleanup of the palette, but he preserves his colors in the same tone or shade that they were previously.

It will be apparent to those skilled in the art that various modifications and variations may be made, and I have illustrated a presently preferred embodiment as required by the patent statutes. I include within the scope of the following claims all such variations and modifications that fall within the true spirit and scope of the invention.

I claim:

1. The combination of:

(a) a watertight container;

(b) an artist's palette disposed inside the container and having a working surface and having oil-based paints exposed on said working surface;

(c) and water disposed in the container and covering the working surface of the palette to exclude air from said paints to thereby prevent drying of the paints.

2. The combination of claim 1 wherein the container is flat and has edges, and a watertight closure is secured to one of said edges, whereby the closure may be opened and the palette inserted and removed from the container without loss of water.

3. The combination of claim 1 wherein the container has guides for the palette to prevent contact of the palette working surface with the container.

4. The method of excluding air from a palette having oil-based paints exposed on the working surface thereof comprising covering said palette and paints working surface with water.

5. The method of preserving oil-based paints exposed on the working surface of a palette comprising immersing said palette in water to a depth to cover said working surface and paints to thereby exclude air from the paints to preserve the paints for future use.

* * * * *